US006742984B1

(12) United States Patent
Itzel et al.

(10) Patent No.: US 6,742,984 B1
(45) Date of Patent: Jun. 1, 2004

(54) DIVIDED INSERT FOR STEAM COOLED NOZZLES AND METHOD FOR SUPPORTING AND SEPARATING DIVIDED INSERT

(75) Inventors: Gary Michael Itzel, Simpsonville, GA (US); Robert Henry Devine, II, Humble, TX (US); John Alan Eastman, Simpsonville, GA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/249,920

(22) Filed: May 19, 2003

(51) Int. Cl.[7] ..... F01D 9/06

(52) U.S. Cl. ..... 415/115; 415/114; 416/96 A; 29/889.722

(58) Field of Search ..... 415/114, 115, 415/116; 416/96 R, 96 A, 97 R; 29/889.722

(56) References Cited

U.S. PATENT DOCUMENTS 3,700,348 A * 10/1972 Corsmeier et al. ..... 416/90 R
4,105,364 A * 8/1978 Dodd ..... 416/97 R
4,946,346 A * 8/1990 Ito ..... 415/115
5,609,466 A * 3/1997 North et al. ..... 415/115
5,634,766 A 6/1997 Cunha et al.
5,711,650 A * 1/1998 Tibbott et al. ..... 415/115
5,743,708 A 4/1998 Cunha et al.
5,762,471 A * 6/1998 Cunha ..... 415/115
5,950,705 A 9/1999 Huang
6,331,096 B1 12/2001 Burdgick et al.
6,386,827 B2 5/2002 Yu et al.
6,394,749 B2 5/2002 Yu et al.
6,398,486 B1 6/2002 Storey et al.
6,402,463 B2 6/2002 Jang et al.
6,406,254 B1 6/2002 Itzel et al.
6,413,040 B1 7/2002 Yu et al.
6,431,824 B2 * 8/2002 Schotsch et al. ..... 415/115
6,435,814 B1 8/2002 Yu et al.
6,450,759 B1 9/2002 Miller et al.
6,453,557 B1 * 9/2002 Burdgick ..... 29/889.722
6,468,031 B1 10/2002 Yu et al.
6,506,013 B1 1/2003 Burdgick et al.
6,517,312 B1 * 2/2003 Jones et al. ..... 415/115

* cited by examiner

*Primary Examiner*—Christopher Verdier
(74) *Attorney, Agent, or Firm*—Nixon & Vanderhye PC

(57) ABSTRACT

A pair of hollow elongated leg sections are disposed in one or more of the nozzle vane cavities of a nozzle stage of a gas turbine. Each leg section has an outer wall portion with apertures for impingement-cooling of nozzle wall portions in registration with the outer wall portions. The leg sections may be installed into the cavity separately and support rods support and maintain the leg sections in spaced relation, whereby the designed impingement gap between the outer wall portions of the leg sections and the nozzle wall portions is achieved. The support rods are secured to the inner wall portions of the leg sections by welding or brazing.

20 Claims, 3 Drawing Sheets

DIVIDED INSERT FOR STEAM COOLED NOZZLES AND METHOD FOR SUPPORTING AND SEPARATING DIVIDED INSERT

BACKGROUND OF INVENTION

The present invention relates to a gas turbine having a closed-circuit cooling system for one or more nozzle stages and, more particularly, to a gas turbine having inserts for impingement-cooling of the nozzle vane walls and which inserts are sectional to facilitate installation into the nozzle vane cavities.

In advanced gas turbines, nozzle stages are often provided with a closed-circuit cooling system for cooling the nozzle vanes exposed to the hot gas path. For example, each nozzle vane may include a plurality of cavities extending between the outer and inner nozzle bands. Impingement-cooling inserts are provided in one or more cavities and a cooling medium such as steam is passed into the insert and through apertures in the side walls of the insert for impingement-cooling the adjacent wall portions of the nozzle vane. An example of a closed-circuit steam-cooled nozzle for a gas turbine is disclosed in U.S. Pat. No. 5,743,708, of common assignee herewith, the disclosure of which is incorporated herein by reference.

Typically, the nozzle insert is a unitary body provided by an insert supplier and nominally sized for reception within the cavity of the nozzle vane. It will be appreciated that the insert is constructed and arranged so that when it is inserted into the vane cavity, an impingement gap is defined between the interior wall of the nozzle and the wall of the insert. However, because of manufacturing tolerances involved with the nozzle cavity and the insert per se, as well as the need to be able to dispose the insert endwise into the nozzle cavity, variations from the designed impingement gap along the length of the insert and nozzle vane wall frequently occur. A variation in the impingement gap can, in turn, cause a significant change in the heat transfer between the nozzle vane walls and the cooling medium. For example, it has been found that a 0.010 inch variation in the gap from a nominal dimension can result in an approximate 13% reduction in heat transfer coefficient. Also, this percentage increases exponentially with further impingement gap variation. Further, installation of a unitary insert into the nozzle vane cavity is somewhat difficult, oftentimes requiring a custom fit. There is also a potential for low-cycle fatigue as a result of the variation in heat transfer coefficient caused by the varying impingement gap.

SUMMARY OF INVENTION

To facilitate design, manufacture and installation of an airfoil impingement insert in steam cooled nozzles, a divided insert is proposed, that may be made in two halves so as to facilitate manufacture and installation. Impingement inserts are typically made of an alloy, such as Inco 625 and have thin wall sections. When an insert is made as a divided structure, with two leg sections, there is a need for a separator structure to maintain the spacing of the individual sections for achieving and maintaining a target impingement gap and for mechanical support. Thus, the invention provides a support and separator bar or rod to provide the support and distance separation required to meet life and operational needs.

A split insert which resulted from a parallel development is disclosed in commonly assigned U.S. Pat. No. 6,450,759, the disclosure of which is incorporated herein by reference. In that adaptation, spreader plates are secured to the inner wall portions of the insert sections to maintain the insert sections spaced from one another. In contrast to the spreader plates of the '759 split insert, the present invention provides an insert having two leg sections with support bars or rods to maintain the insert sections spaced from one another. The rod-type support has the significant advantages of reduced area, greater strength, and easy and secure attachment.

Thus, the invention is embodied in an insert for a cavity of a nozzle vane of a gas turbine for impingement-cooling of the walls of the vane, comprising: a pair of elongated hollow leg sections disposable in side-by-side relation to one another within the cavity, said leg sections having a plurality of apertures through oppositely directed outer walls thereof, inner wall portions of the leg sections being spaced from one another; and at least one support rod extending between said inner wall portions of said leg sections for maintaining said inner wall portions of said leg sections spaced from one another.

The invention is also embodied in an insert disposed in a cavity of a nozzle vane of a gas turbine for impingement-cooling walls of the vane, wherein the assembly comprises: a pair of elongated hollow insert leg sections disposable in side-by-side relation to one another within the cavity, said leg sections having a plurality of apertures through oppositely directed outer walls thereof, inner wall portions of the leg sections being spaced from one another; and at least one support rod disposed to extend between said leg sections for maintaining said inner wall portions of said leg sections spaced from one another, first end portions of said leg sections having inner wall surfaces disposed for engagement with one another to facilitate securement of said leg sections to one another. The invention may also be embodied in a method of installing a cooling medium insert into a cavity of a nozzle vane for a gas turbine wherein the insert includes a pair of elongated hollow leg sections, each having an outer wall portion with a plurality of apertures therethrough, comprising: (a) inserting the leg sections into the vane cavity for disposition therein in side-by-side relation to one another, with the outer wall portions thereof in opposed facing relation to side wall portions of said vane; and (b) subsequent to step (a), and while the leg sections remain in the vane cavity, inserting a support rod to extend between spaced inner wall portions of said leg sections to support and maintain said leg sections in spaced relation.

BRIEF DESCRIPTION OF DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION

Figure 1:
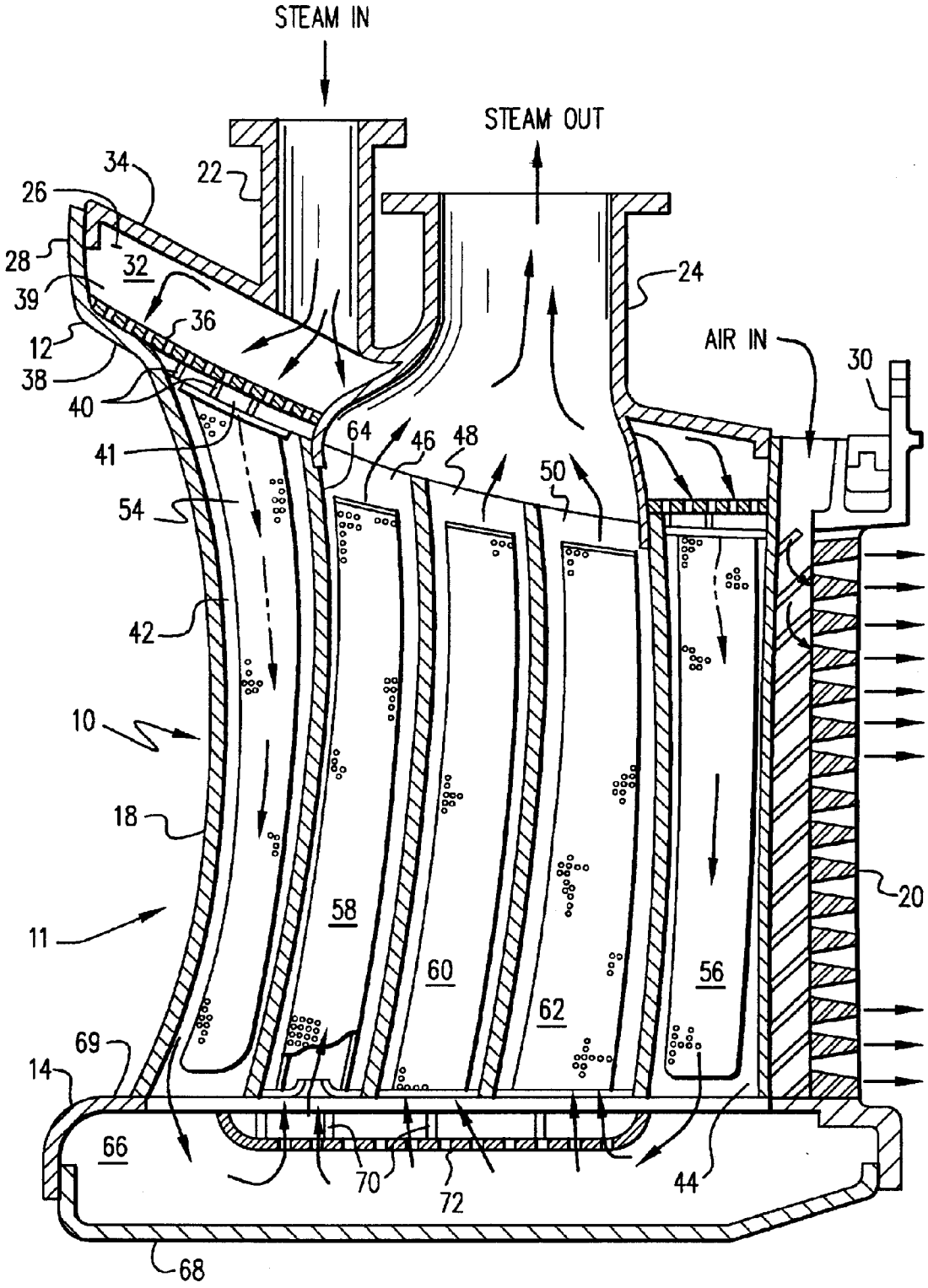
FIG. 1 is an enlarged cross-section of a conventional first-stage nozzle vane.
Figure 2:
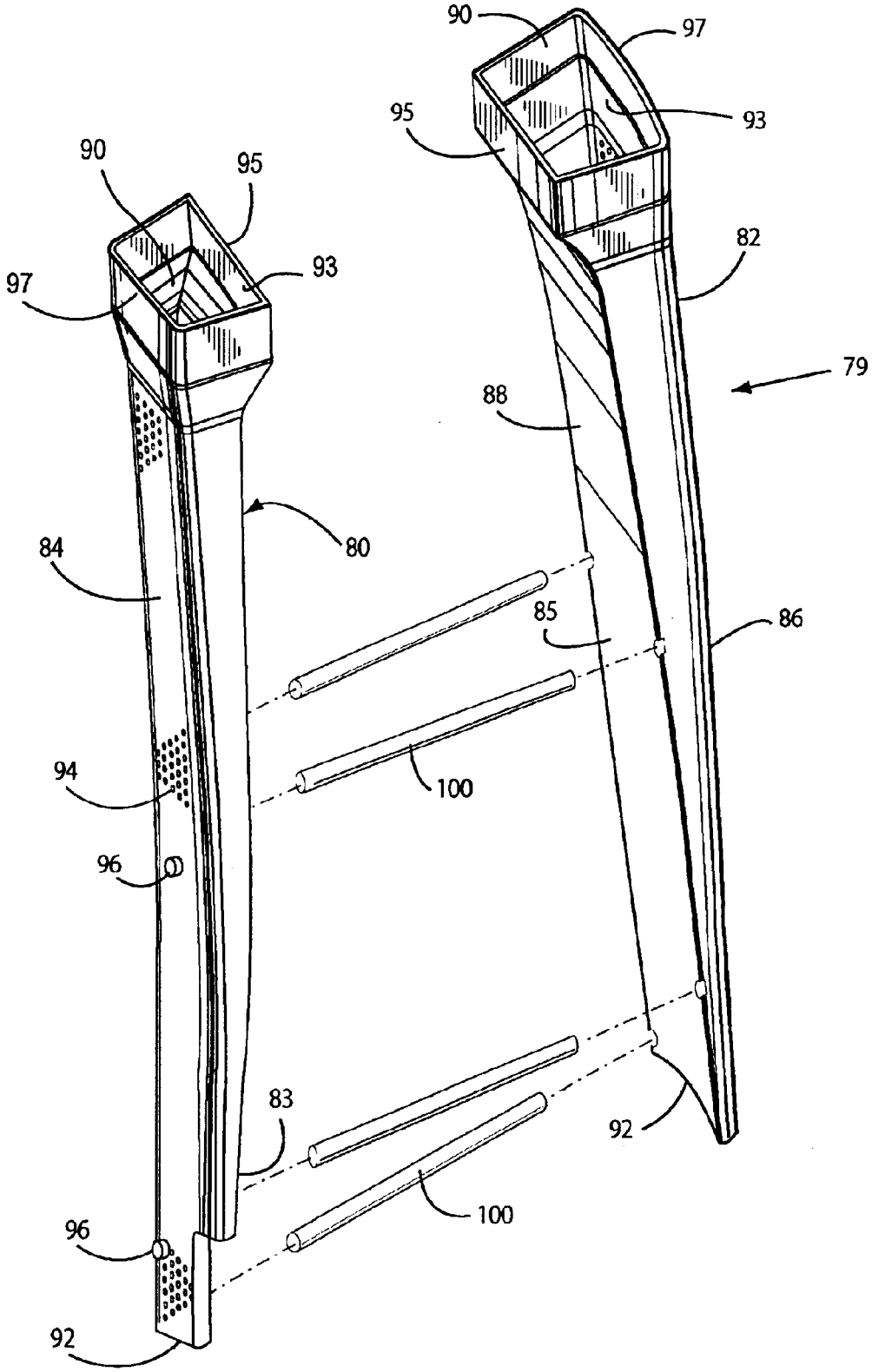
FIG. 2 is an exploded perspective view of a pair of leg sections and support rods constructed in accordance with an embodiment of the present invention and prior to installation into a nozzle vane cavity.

As discussed previously, the present invention relates to closed cooling circuits for nozzle stages of a turbine, preferably a first-stage nozzle. Reference is made to U.S. Pat. No. 5,743,708 for disclosure of various other aspects of a turbine, its construction and methods of operation. Referring now to FIG. 1, there is schematically illustrated in cross-section a vane 10 comprising one of a plurality of circumferentially spaced vanes, each vane forming part of an arcuate segment 11 of a first-stage nozzle for a gas turbine. It will be appreciated that the segments 11 are connected one to the other to form an annular array of segments defining the hot gas path through the first-stage nozzle of the turbine. Each segment includes radially spaced outer and inner bands 12 and 14, respectively, with one or more of the nozzle vanes 10 extending between the outer and inner bands. The segments are supported about the inner shell of the turbine (not shown) with adjoining segments being sealed one to the other. For purposes of this description, the vane 10 will be described as forming the sole vane of a segment, it being appreciated that each segment 11 may have two or more vanes. As illustrated, the vane 10 has a leading edge 18 and a trailing edge 20.

The cooling circuit for the illustrated first-stage nozzle vane segment of FIG. 1 has a cooling steam inlet 22 to the outer band 12. A return steam outlet 24 also lies in communication with the outer band of the nozzle segment. The outer band 12 includes an outer side railing/wall 26, a leading railing/wall 28, and a trailing railing/wall 30 defining a plenum 32 with an upper cover 34 and an impingement plate 36 disposed in the outer band 12. (The terms outwardly and inwardly or outer and inner refer to a generally radial direction). Disposed between the impingement plate 36 and the wall 38 of outer band 12 are a plurality of structural ribs 40 extending between the side walls 26, forward wall 28 and trailing wall 30. The impingement plate 36 overlies the ribs 40 throughout the full extent of the plenum 32. Consequently, steam entering through inlet 22 into plenum 32 passes through the openings in the impingement plate 36 for impingement cooling of the wall 38 of the outer band 12, the outer band thus having first and second chambers 39 and 41 on opposite sides of the impingement plate.

Figure 5:
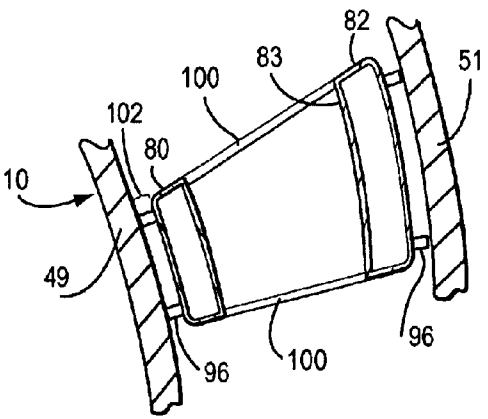
FIG. 5 is a cross-sectional view of the leg sections and support rods taken generally on line 5—5 in FIG. 4.

The first-stage nozzle vane 10 also has a plurality of cavities, for example, the leading edge cavity 42, an aft cavity 44, three intermediate return cavities 46, 48 and 50, and a trailing edge cavity. These cavities are defined by transversely extending ribs extending between opposite side walls 49 and 51 (FIG. 5) of the vane. One or more additional or fewer cavities may be provided.

Leading edge cavity 42 and aft cavity 44 each have an insert, 54 and 56 respectively, while each of the intermediate cavities 46, 48 and 50 have similar inserts 58, 60 and 62, respectively, all such inserts being in the general form of hollow sleeves. The inserts may be shaped to correspond to the shape of the particular cavity in which the insert is to be provided. The side walls of the sleeves are provided with a plurality of impingement cooling apertures, along portions of the insert which lie in opposition to the walls of the vane to be impingement cooled. For example, in the leading edge cavity 42, the forward edge of the insert 54 is arcuate and the side walls would generally correspond in shape to the side walls of the cavity 42, all such walls of the insert having impingement apertures. The back side of the sleeve or insert 54 in opposition to the rib 64 separating cavity 42 from cavity 46, however, does not have impingement apertures. In the aft cavity 44, on the other hand, the side walls, only, of the insert sleeve 56 have impingement apertures; the forward and aft walls of insert sleeve 56 being of a solid non-perforated material.

It will be appreciated that the inserts received in cavities 42, 44, 46, 48, and 50 are spaced from the walls of the cavities to enable a cooling medium, e.g., steam, to flow through the impingement apertures to impact against the interior wall surfaces of the nozzle vane, thus cooling those wall surfaces. As will be apparent from the ensuing description, inserts 54 and 56 are closed at their radially inner ends and open at their radially outer ends. Conversely, inserts 58, 60 and 62 are closed at their radially outer ends and open at their radially inner ends.

As illustrated in FIG. 1, the post-impingement cooling medium, e.g., steam, cooling the outer wall 38 flows into the open radially outer ends of inserts 54 and 56 for impingement-cooling of the vane walls in registration with the impingement apertures in the inserts along the length of the vane. The spent impingement steam then flows into a plenum 66 in the inner band 14 which is closed by an inner cover plate 68. Structural strengthening ribs 70 are integrally cast with the inner wall 69 of band 14. Radially inwardly of the ribs 70 is an impingement plate 72. As a consequence, it will be appreciated that the spent impingement cooling steam flowing from cavities 42 and 44 flows into the plenum 66 and through the impingement apertures of impingement plate 72 for impingement cooling of the inner wall 69. The spent cooling steam flows by direction of the ribs 70 towards openings in ribs 70 (not shown in detail) for return flow to the steam outlet 24. Particularly, inserts 58, 60 and 62 are disposed in the cavities 46, 48, and 50 in spaced relation from the side walls and ribs defining the respective cavities. The impingement apertures of inserts 58, 60 and 62 lie along the opposite sides thereof in registration with the vane walls. Thus, the spent cooling steam flows through the open inner ends of the inserts 58, 60 and 62 and through the impingement apertures for impingement cooling the adjacent side walls of the vane. The spent cooling steam then flows out the outlet 24 for return, e.g., to the steam supply, not shown. The air cooling circuit of the trailing edge cavity of the combined steam and air cooling circuits of the vane illustrated in FIG. 1 generally corresponds to the cooling circuit disclosed in the '708 patent. Therefore, a detailed discussion thereof is omitted.

As noted previously, the inserts in the cavities define an impingement gap between the apertured walls of the insert and the adjacent nozzle wall portions which can vary significantly from a designed gap resulting in variations of heat transfer and lower life-cycle fatigue. Those problems are caused by stackup of manufacturing tolerances, difficulty in installation of the inserts and the resulting variation from the designed impingement gap.

In an embodiment of the present invention, there is provided a split insert comprising first and second leg sections. In the illustrated embodiment, the split insert, generally designated 79, is formed in two parts, so that the leg sections 80 and 82 are defined by a pair of discrete insert bodies. Leg sections 80 and 82 comprise respective hollow elongated sleeves, each having an outer side wall 84, 86 and an inner wall 83, 85. Each leg section 80 and 82 has an open end 90 of generally rectilinear configuration. The outer side walls 84, 86 and inner wall portions 83, 85 of each leg section generally converge toward one another from the open end 90 to the closed opposite end 92. It should be noted that the large cut out section at the closed end of leg section 80 is provided as clearance for another insert assembly that enters the nozzle segment on the other side and, as such, that detail is not a feature of the invention per se.

The outer side wall 84, 86 of each leg section 80 and 82 has a plurality of apertures 94 for passing a cooling medium received within the leg section through opening 90 toward the registering side wall portions of the nozzle vane when the insert is disposed in the nozzle. Additionally, end portions 93 of leg sections 80 and 82 have inner wall portions 95 adjacent the open ends of the leg sections configured to abut one another whereby the leg sections can be joined one to the other after installation into the nozzle cavity by a welding or brazing operation. The outer edges 97 about the open ends 90 of the leg sections are also configured for securement to the nozzle per se after installation, also by a welding or brazing operation. Standoffs 96 are provided at various locations along the outer wall 84, 86 of each leg section 80 and 82. The standoffs 96 comprise projections which project from the outer wall surface for engagement with the interior wall surface of the nozzle wall when installed.

Figure 3:
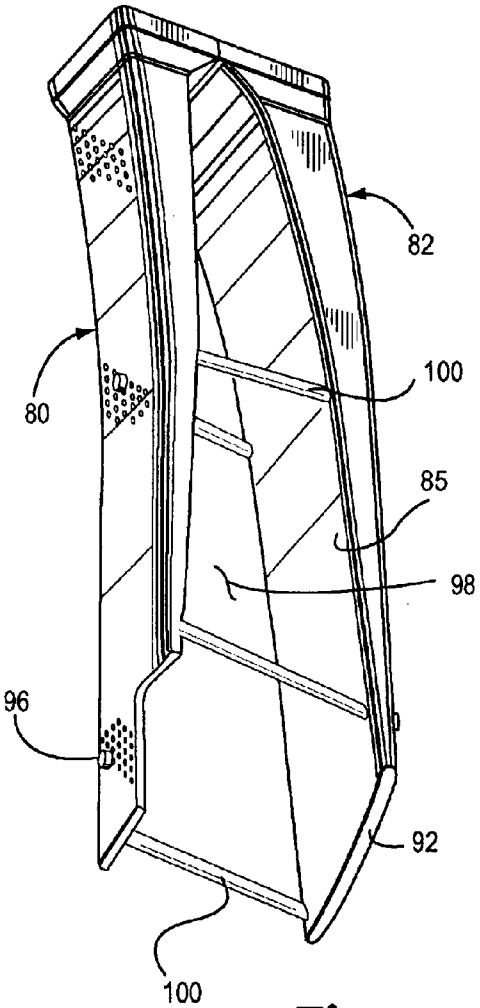
FIG. 3 is a perspective view from below of the insert of FIG. 1 as it would appear within the nozzle vane cavity.

The inner wall portion 83, 85 of each leg section 80, 82 is tapered from its open end 90 toward the outer wall 84, 86 and toward the opposite end 92 of each leg section. Consequently, a gap 98 (FIG. 3) is provided between the leg sections upon installation within the nozzle cavity. Support bars or rods 100 are provided upon installation for maintaining the standoffs 96 engaged against the inner wall surfaces of the nozzle vane wall. It will be appreciated that one or more support rods 100 may be provided at longitudinal positions along the length of the leg sections 80 and 82. Particularly where a cut out, such as adjacent the closed end of leg section 80, or other structure is provided that precludes the placement of a support rod, the support rods may be asymmetrically disposed along respective sides of the leg sections, as in the illustrated embodiment. Furthermore, from a review of FIG. 5, it will be appreciated that the leg sections 80 and 82 are not necessarily identical to one another, and will typically differ. Thus, as illustrated, leg section 80 is narrower in a chordal direction than leg section 82 in accordance with their disposition adjacent the concave and convex sides 49, 51, respectively, of the vane.

To install the two-part insert into a cavity, each leg section 80 and 82 is inserted separately into the cavity with the open ends 90 of the leg sections aligned with one another and with the nozzle wall to which the leg sections will be secured. After insertion of each leg section, one or more support rods 100 are disposed between the inner wall portions 83, 85 of the leg sections. The leg sections are thus flexed outwardly away from one another to engage the standoffs 96 against the inner wall surfaces 49, 51 of the nozzle vane. Once correctly positioned, the support rods 100 can be secured to the inner walls 83, 85, for example, by welding or brazing.

Figure 6:
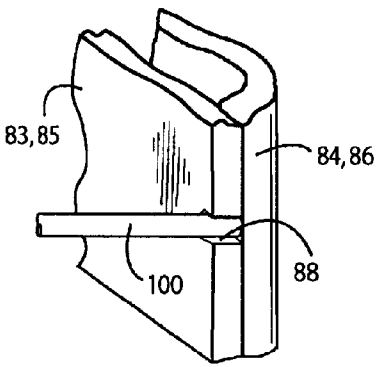
FIG. 6 is a partial perspective view showing the coupling of a support rod to a leg section in an embodiment of the invention.
Figure 4:
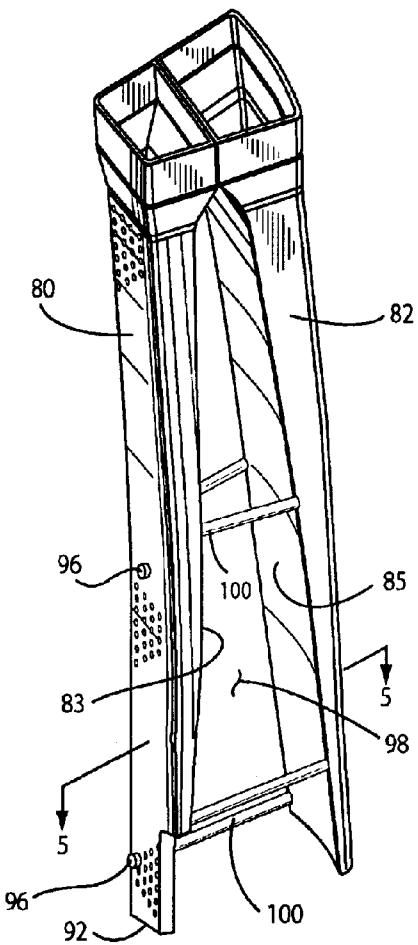
FIG. 4 is a perspective view similar to FIG. 3, but taken from above.

An exemplary junction of a support rod 100 and a leg section 80, 82 is illustrated in FIG. 6. In this embodiment, a cutout 88 is defined at an appropriate point along the longitudinal side edge of the inner wall portions 83, 85 for receiving the respective longitudinal end of the support rod 100. The support rod 100 may then be easily and reliably brazed or welded to the leg sections at a predetermined point along the length of the leg section 80, 82. Also, the receptacle for the support rod defined by the cutout 88 enhances the security of the bond.

Where the insert is provided as two discrete parts, the open end 90 of each leg section 80 and 82 is then secured to one another and to the surrounding nozzle wall by brazing or welding. As a consequence of this installation procedure, the designed impingement gap 102 (FIG. 5) between the outer wall 84, 86 of each leg section and the opposing wall surface of the nozzle vane is obtained. It will be appreciated that the leg sections are inserted into a vane cavity through openings in the inner or outer band depending upon the direction of the flow of the cooling medium within the cavity, the open end 90 being at the cooling medium inlet end of the cavity.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An insert for a cavity of a nozzle vane of a gas turbine for impingement-cooling of the walls of the vane, comprising:

a pair of elongated hollow leg sections disposable in side-by-side relation to one another within the cavity, said leg sections having a plurality of apertures through oppositely directed outer walls thereof, inner wall portions of the leg sections, being spaced from one another; and at least one support rod extending between said inner wall portions of said leg sections for maintaining said inner wall portions of said leg sections spaced from one another.

2. An insert according to claim 1 including standoffs spaced from one another along said outer walls of said leg sections and extending outwardly from said outer walls for engagement with walls of said vane facing thereto, to define an impingement gap between said outer walls and said walls of said vane.

3. An insert according to claim 1 wherein each of said leg sections has an open end for receiving a cooling medium for flow thereinto and through said apertures for impingement-cooling walls of the vane facing thereto.

4. An insert according to claim 3 wherein ends of each of said leg sections opposite said open ends are closed.

5. An insert as in claim 1, wherein each said inner wall portion includes a receptacle for receiving a longitudinal end of a respective support rod.

6. An insert as in claim 5, wherein said receptacle comprises a cutout defined in a longitudinal side edge of said inner wall portion.

7. An insert as in claim 1, wherein each longitudinal end of said support rod is brazed or welded to said respective inner wall portion.

8. An insert according to claim 1, wherein there are a plurality of support rods extending between said inner wall portions of said leg sections and at spaced locations along the lengths of said leg sections for maintaining said inner wall portions of said leg sections spaced from one another.

9. An insert disposed in a cavity of a nozzle vane of a gas turbine for impingement-cooling walls of the vane, the assembly comprising:

a pair of elongated hollow insert leg sections disposable in side-by-side relation to one another within the cavity, said leg sections having a plurality of apertures through oppositely directed outer walls thereof, inner wall portions of the leg sections being spaced from one another; and at least one support rod disposed to extend between said leg sections for maintaining said inner wall portions of said leg sections spaced from one another, first end portions of said leg sections having inner wall surfaces disposed for engagement with one another to facilitate securement of said leg sections to one another.

10. The assembly of claim 9, wherein there are a plurality of support rods extending between said inner wall portions of said leg sections and at spaced locations along the lengths of said leg sections for maintaining said inner wall portions of said leg sections spaced from one another.

11. The assembly of claim 9, wherein each leg section includes at least one standoff extending outwardly from said outer wall thereof for engagement with an opposed side wall portion of said vane, each said support rod maintaining said standoffs in engagement with the side wall portions of said vane to maintain a predetermined gap between said outer walls of said leg sections and said side wall portions of said vane.

12. The assembly of claim 9, wherein said leg sections are secured to one another and to said nozzle vane.

13. The assembly of claim 11, wherein each of said leg sections has an open end for receiving a cooling medium for flow therethrough and through said apertures for impingement-cooling said side wall portions of the vane, end portions of each of said leg sections opposite said open ends thereof being closed.

14. The assembly of claim 9, wherein each said inner wall portion includes a receptacle for receiving a longitudinal end of a respective support rod.

15. The assembly of claim 14, wherein said receptacle comprises a cutout defined in a longitudinal side edge of said inner wall portion.

16. The assembly of claim 9, wherein each longitudinal end of said support rod is brazed or welded to said respective inner wall portion.

17. A method of installing a cooling medium insert into a cavity of a nozzle vane for a gas turbine wherein the insert includes a pair of elongated hollow leg sections, each having an outer wall portion with a plurality of apertures therethrough, comprising:

(a) inserting the leg sections into the vane cavity for disposition therein in side-by-side relation to one another, with the outer wall portions thereof in opposed facing relation to side wall portions of said vane; and (b) subsequent to step (a), and while the leg sections remain in the vane cavity, inserting a support rod to extend between spaced inner wall portions of said leg sections to support and maintain said leg sections in spaced relation.

18. A method according to claim 17, wherein each of the leg sections has an open end for receiving a cooling medium and further comprising securing the leg sections to one another at or adjacent said open ends thereof.

19. A method according to claim 17, wherein said insert has an open end for receiving a cooling medium and further comprising securing the insert to said nozzle vane at or adjacent said open end.

20. A method according to claim 17, wherein said insert further includes at least one standoff one of defined on and mounted to said outer wall portion of each said leg section and wherein said inserting of said support rod between said leg sections flexes said leg sections outwardly to engage the standoffs with the side wall portions of the vane, whereby the outer wall portions of said leg sections are spaced a predetermined distance from said side wall portions of said vane.

* * * * *